US010302405B1

(12) United States Patent
McGrane

(10) Patent No.: US 10,302,405 B1
(45) **Date of Patent: *May 28, 2019**

(54) SUPERDETONATION DEVICES AND METHODS FOR MAKING AND USING THE SAME

(71) Applicant: Los Alamos National Security, LLC, Los Alamos, NM (US)

(72) Inventor: Shawn D. McGrane, Los Alamos, NM (US)

(73) Assignee: TRIAD NATIONAL SECURITY, LLC, Los Alamos, NM (US)

( * ) Notice: Subject to any disclaimer, the term of this patent is extended or adjusted under 35 U.S.C. 154(b) by 46 days.

This patent is subject to a terminal disclaimer.

(21) Appl. No.: 15/878,233

(22) Filed: Jan. 23, 2018

Related U.S. Application Data

(63) Continuation of application No. 15/084,331, filed on Mar. 29, 2016, now Pat. No. 9,921,042.

(60) Provisional application No. 62/141,085, filed on Mar. 31, 2015.

(51) Int. Cl.

| | |
|---|---|
| ***F42D 3/00*** | (2006.01) |
| ***F42D 5/04*** | (2006.01) |
| ***F42B 3/08*** | (2006.01) |
| ***F42B 1/02*** | (2006.01) |
| ***F42B 12/20*** | (2006.01) |
| ***F42B 12/10*** | (2006.01) |
| *F42B 3/00* | (2006.01) |

(52) U.S. Cl.
CPC ..... *F42D 3/00* (2013.01); *F42B 1/02* (2013.01); *F42B 3/08* (2013.01); *F42B 12/10* (2013.01); *F42B 12/207* (2013.01); *F42D 5/04* (2013.01); *F42B 3/00* (2013.01); *F42B 12/20* (2013.01)

(58) Field of Classification Search
CPC .... F42B 1/00; F42B 1/02; F42B 1/024; F42B 1/028; F42B 1/032; F42B 3/00; F42B 3/08; F42B 12/10; F42B 12/20; F42B 12/207; F42D 3/00; F42D 3/02; F42D 3/04; F42D 3/06; F42D 5/04; F42C 19/08
USPC ..... 102/305, 306, 307, 309, 475, 476; 86/50
See application file for complete search history.

(56) References Cited

U.S. PATENT DOCUMENTS

| | | | | |
|---|---|---|---|---|
| 2,809,585 | A * | 10/1957 | Moses | F42B 1/024 102/476 |
| 2,900,905 | A * | 8/1959 | MacDougall | F42B 1/024 102/306 |
| 3,100,445 | A * | 8/1963 | Poulter | C06B 23/001 102/309 |
| 3,100,455 | A | 8/1963 | Dorey | |
| 3,384,262 | A | 5/1968 | Fritsche | |
| 3,444,811 | A | 5/1969 | Abbott et al. | |

(Continued)

OTHER PUBLICATIONS

Campbell et al., "Shock Initiation of Detonation in Liquid Explosives," *Physics of Fluids*, 4(4): 498-510, Apr. 1961.

(Continued)

*Primary Examiner* — James S Bergin
(74) *Attorney, Agent, or Firm* — Klarquist Sparkman, LLP

(57) ABSTRACT

Disclosed herein are embodiments of devices comprising energetic materials capable of superdetonation and methods of making and using such devices. The devices disclosed herein comprise components, dimensions, and configurations optimized to utilize superdetonation velocities produced by the energetic materials disclosed herein.

19 Claims, 4 Drawing Sheets

(56) References Cited

U.S. PATENT DOCUMENTS

| | | | | |
|---|---|---|---|---|
| 3,906,857 | A * | 9/1975 | Rotondi, Jr. | F42B 1/024 102/428 |
| 4,099,464 | A | 7/1978 | Cross et al. | |
| 4,213,391 | A | 7/1980 | Drimmer | |
| 6,467,416 | B1 * | 10/2002 | Daniels | F42B 12/10 102/476 |
| 6,925,924 | B2 | 8/2005 | Baker et al. | |
| 7,513,198 | B2 * | 4/2009 | Zhang | F42B 1/00 102/306 |
| 9,822,617 | B2 * | 11/2017 | Bird | E21B 43/1185 |
| 9,921,042 | B1 * | 3/2018 | McGrane | F42C 19/08 |
| 2016/0216085 | A1 | 7/2016 | Scheid et al. | |
| 2017/0227340 | A1 * | 8/2017 | Van Niekerk | F42C 19/09 |

OTHER PUBLICATIONS

Cartwright et al., "Non-Solid Explosives for Shaped Charges I: Explosive Parameters Measurements for Sensitized Liquid Explosives," *Journal of Energetic Materials*, 25(2): 111-127, Mar. 22, 2007.

Cartwright et al., "Non-Solid Explosives for Shaped Charges. Part II. Target Penetration with Metal Liner Devices Using Sensitized Nitromethane Liquid Explosive," *Journal of Energetic Materials*, 27(3): 145-165, Apr. 21, 2009.

Cartwright et al., "Non-Solid Explosives for Shaped Charges. Part III. Metal Liner Devices Used in Explosive Ordnance Disposal Operations," *Journal of Energetic Materials*, 27(3): 166-185, Apr. 21, 2009.

Engelke et al., "Effect of a chemical inhomogeneity on steady-state detonation velocity," *Physics of Fluids*, 23(5): 875-880, May 1980.

Gruzdkov et al., "Emission and Fluorescence and Spectroscopy to Examine Shock-Induced Decomposition in Nitromethane," *J. Phys. Chem.*, 102(43): 8325-8332, Oct. 1, 1998.

Hardesty et al., "An Investigation of the Shock Initiation of Liquid Nitromethane," *Combustion and Flame*, vol. 27, pp. 229-251, 1976 (available online Aug. 7, 2003).

Jacobs et al., "The Shock-to-Detonation Transition in Solid Explosives," published by United States Naval Ordnance Laboratory, Nov. 13, 1962.

Menikoff et al., "Modeling detonation waves in nitromethane," *Combustion and Flame*, vol. 158, pp. 2549-2558, Jun. 12, 2011.

Menikoff, "Detonation waves in PBX 9501," *Combustion Theory and Modelling*, 10(6): 1003-1021, Dec. 2006.

Rice et al., "Compression of Solids by Strong Shock Waves," *Solid State Physics*, vol. 6, 45 pages, 1958 (available online Jun. 24, 2008).

Sheffield, et al., "Homogeneous Shock Initiation Process in Neat and Chemically Sensitized Nitromethane," *13th International Detonation Symposium* (2006), p. 401-407.

Simon, "The Effect of Explosive Detonation Characteristics on Shaped Charge Performance," published by Army Ballistic Research Lab, 15 pages, Jan. 1974.

Simpson et al., "CL-20 Performance Exceeds That of HMX and its Sensitivity is Moderate," *Propellants, Explosives, Pyrotechnics*, vol. 22, 249-255, Oct. 1997.

Tarver et al., "Detonation waves in pentaerythritol tetranitrate," *Journal of Applied Physics*, 81(11): 7193-7202, Jun. 1997.

Walters, "Introduction to Shaped Charges," published by Army Research Laboratory, 124 pages, Mar. 2007.

Winey et al., "Equation of state and temperature measurements for shocked nitromethane," *Journal of Chemical Physics*, 113(17): 7492-7501, Nov. 1, 2000.

Zukas et al., "High-Pressure Shock Compression of Condensed Matter," *Explosive Effects and Applications*, Springer Science + Business Media, 1998.

* cited by examiner

SUPERDETONATION DEVICES AND METHODS FOR MAKING AND USING THE SAME

CROSS REFERENCE TO RELATED APPLICATION

This application is a continuation of co-pending U.S. patent application Ser. No. 15/084,331, filed on Mar. 29, 2016, which claims the benefit of, and priority to, the earlier filing date of U.S. Provisional Patent Application No. 62/141,085, filed on Mar. 31, 2015; the entirety of each of these prior applications is hereby incorporated herein by reference.

ACKNOWLEDGMENT OF GOVERNMENT SUPPORT

This invention was made with government support under Contract No. DEAC52-06NA25396 awarded by the U.S. Department of Energy. The government has certain rights in the invention.

FIELD

Disclosed herein are embodiments of energetic materials and devices that utilize superdetonation to provide improved performance. Also disclosed herein are methods of making and using devices comprising the energetic materials.

BACKGROUND

Superdetonation is the consequence of thermally initiated chemical kinetics induced by shock heating of homogenous explosives such as liquids. Superdetonation has been studied most extensively in liquid nitromethane and the phenomenon typically exists for less than a microsecond. Conventional shaped charges use the detonation of precision machined plastic explosives with detonation velocities <9 km/s to achieve high velocity metal jets used for target penetration. Methods of increasing the explosive's detonation velocity to increase penetration of shaped charges, reducing the amount and sensitivity of the explosive, and decreasing the cost of high performance shaped charges, are needed in the art.

SUMMARY

Disclosed herein are embodiments of a device, comprising: a housing having a proximal portion and a distal portion; a liner positioned at a distal end of the housing; a detonator positioned in the proximal portion of the housing; a first chamber positioned in the distal portion of the housing, wherein the first chamber is configured to contain an energetic material capable of superdetonation and which has a length that is sufficient to allow an input pressure wave to initiate a superdetonation wave produced by the energetic material that contacts the liner prior to relaxation of the superdetonation wave to normal detonation pressure; and a second chamber suitable configured to contain an attenuator, wherein the second chamber is positioned between a detonator and the first chamber. In some embodiments, the device further comprises a third chamber configured to contain a booster material, wherein the third chamber is positioned between the detonator and the second chamber. The liner of the device is sufficiently thin so as to be expelled from the device upon contact of the superdetonation wave produced by the energetic material.

In some embodiments of the device, the first chamber comprises an energetic material capable of superdetonation. In yet additional embodiments, the second chamber can comprise an attenuator. In any or all of the above embodiments, the attenuator is capable of shaping an input pressure to initiate superdetonation of the energetic material. In any or all of the above embodiments, the energetic material comprises a homogeneous material selected from nitromethane, nitroglycerin, ethylene glycol dinitrate, pentaerythritol tetranitrate, erythritol tetranitrate, or trinitrotoluene. In some embodiments, the third chamber comprises a booster, which can comprise an energetic material and an amine component. The devices disclosed herein can be used for IED defeat, ordinance disposal, high-explosive anti-tank (HEAT) munitions, demolition, or combinations thereof.

Also disclosed herein are embodiments of a method for making a device, comprising placing an energetic material capable of superdetonation into a first chamber of a housing, wherein the first chamber is located in a distal portion of the housing and has a length that is sufficient to allow an input pressure wave to initiate a superdetonation wave produced by the energetic material that contacts the liner prior to relaxation of the superdetonation wave to normal detonation pressure; placing an attenuator into a second chamber of the housing; and placing a detonator in a proximal portion of the housing. In some embodiments, the method can further comprise placing a booster in a second chamber of the housing, wherein the second chamber is located in the proximal end of the housing. In such embodiments, the method can further comprise placing a sensitizer component in the first chamber.

Also disclosed herein are embodiments of methods for projecting a liner, comprising superdetonating the energetic material contained within the devices disclosed herein, so as to project the metal at a velocity that can reach up to 140% higher, such as from 30% higher to 140% higher, 50% higher to 140% higher, or 30% higher to 50% higher than a flyer velocity produced by regular detonation. Methods of using the devices disclosed herein also are disclosed. Such methods can involve using a device embodiment to impact or penetrate a target, wherein the methods can comprise positioning the device at a distance ranging up to 100 charge diameters from the target and detonating the device. In some embodiments, the method produces a 50% or higher increase in penetration depth and 100% or higher increase in hole volume.

The foregoing and other objects, features, and advantages will become more apparent from the following detailed description, which proceeds with reference to the accompanying figures.

DETAILED DESCRIPTION

I. Explanation of Terms

Figure 1:
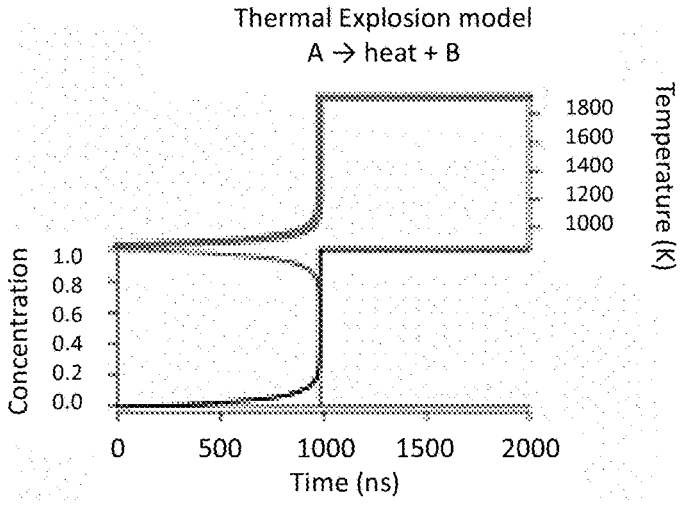
FIG. 1 is a direct numerical simulation of Arrhenius kinetics for an exothermic reaction illustrating the thermal explosion effect after an appropriate induction time.

The following explanations of terms are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Any theories of operation are to facilitate explanation, but the disclosed devices, materials, and methods are not limited to such theories of operation. Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed components and materials can be used in conjunction with other components and materials. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In some examples, values, procedures, or devices are referred to as "lowest," "best," "minimum," or the like. It will be appreciated that such descriptions are intended to indicate that a selection among many used functional alternatives can be made, and such selections need not be better, smaller, or otherwise preferable to other selections.

Examples are described with reference to directions indicated as "above," "below," "upper," "lower," and the like. These terms are used for convenient description, but do not imply any particular spatial orientation.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting, unless otherwise indicated. Other features of the disclosure are apparent from the following detailed description and the claims.

Unless otherwise indicated, all numbers expressing quantities of components, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under standard test conditions/methods. When directly and explicitly distinguishing embodiments from discussed prior art, the embodiment numbers are not approximates unless the word "about" is recited. Furthermore, not all alternatives recited herein are equivalents.

To facilitate review of the various embodiments of the disclosure, the following explanations of specific terms and abbreviations are provided:

Flyer velocity: The velocity of an accelerated liner after explosive detonation.

Normal Detonation: Detonation of an energetic material disclosed herein that does not produce a transient, high detonation velocity. In some embodiments, normal detonation can range from 1800 m/s to 4000 m/s for gases and 4000 m/s to 9000 m/s for a solid energetic material.

Superdetonation: Superdetonation occurs when energetic materials (e.g., homogeneous explosives) are shock heated (that is, heated by a shock wave) to a degree that leads to exothermic reactions slowly building behind the shock wave. An energetic material is capable of superdetonation when it has chemical and physical properties sufficient to allow the energetic material to provide a transient, high detonation velocity that is not achieved with normal detonation of the material.

Superdetonation wave: A shock wave that travels through a preshocked energetic material until it overtakes an initial shock wave of the material. The velocity of a superdetonation wave is increased by the compression of the shocked material, the particle velocity imparted by the first shock, and the reactive thermal explosion driving it.

DETA—diethylenetriamine
EDA—ethylenediamine
EGDN—ethylene glycol dinitrate
ETN—erythritol tetranitrate
HMX—octogen, Octahydro-1,3,5,7-tetranitro-1,3,5,7-tetrazocine
HNS—hexanitrostilbene
NG—nitroglycerin
NTO—3-nitro-1,2,4-triazol-5-one
PETN—pentaerythritol tetranitrate
TATB—triaminotrinitrobenzene
TNT—trinitrotoluene

II. Introduction

Arrhenius kinetics leads to the phenomenon of thermal explosion in energetic materials that undergo exothermic chemical reactions. The chemical reaction rate law is modeled as $k=(1-\lambda)A\exp(-E_a/(k_BT))$, where k is the rate, $\lambda$ is the fraction reacted, A is a frequency factor or attempt frequency, $E_a$ is an activation energy or barrier to reaction, $k_B$ is Boltzmann's constant, and T is the temperature. A weak shock can heat energetic materials to the point that reaction begins, but occurs slowly. However, the heat released by the reaction makes the rate increase, which releases heat faster, which in turn accelerates the reaction in a positive feedback cycle. This acceleration leads to the sudden occurrence of thermal explosion after an appropriate induction time, as shown in FIG. 1, which occurs for reactions that are exothermic, high $E_a$, and start at a temperature that has a low initial rate on the timescale of interest. Most heterogeneous explosives are comprised of many molecular crystals of tens to hundreds of micrometers in size with a plastic binding them together. These heterogeneous materials shock into inhomogeneous temperature distributions that average out the sharp thermal explosion illustrated in FIG. 1. Shocked homogeneous energetic materials, however, do not exhibit this effect.

Figure 2:
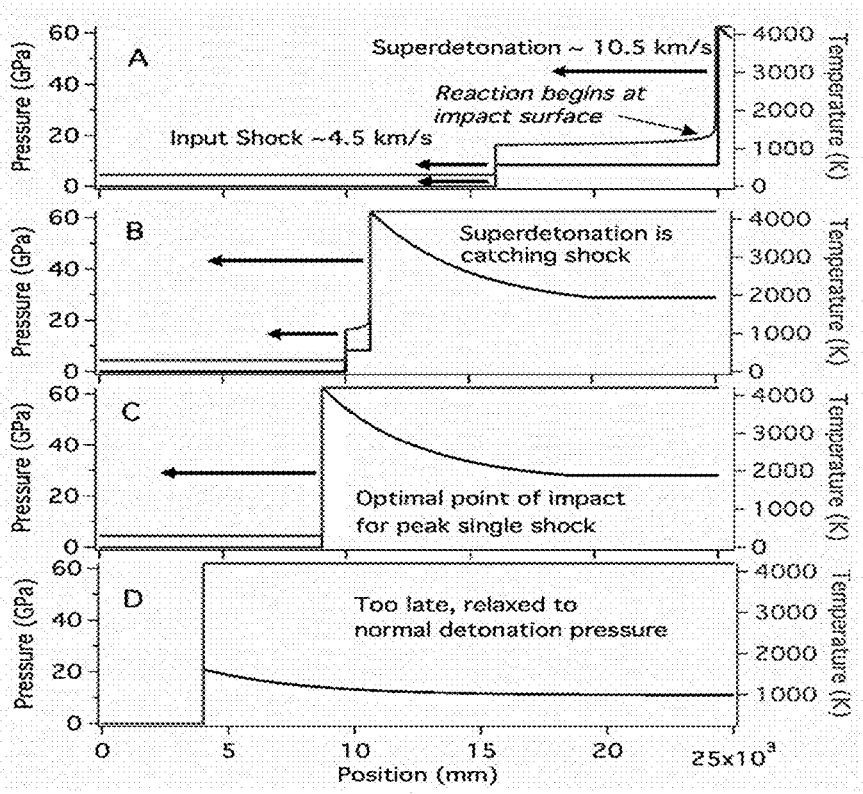
FIG. 2 provides a combination of graphs illustrating the progression of a superdetonation wave, which occurs due to the thermal explosion at the shock entry surface as a consequence of the exothermic Arrhenius decomposition kinetics.

Superdetonation occurs when energetic materials (e.g., homogeneous energetic materials) are shock heated to a degree that leads to exothermic reactions slowly building behind the shock wave. FIG. 2 illustrates the basic processes involved in superdetonation. With reference to FIG. 2, material closest to the shock entry surface has the most time to react exothermically, and is therefore the hottest. Eventually, the self-heating accelerates the reaction rate by orders of magnitude, which leads to a thermal explosion that drives a pressure wave forward into the shocked material. The velocity of this wave is increased by the compression of the shocked material, the particle velocity imparted by the first shock, and the reactive thermal explosion driving it. This is the superdetonation wave observed in certain energetic materials, such as those disclosed herein. Once the superdetonation wave reaches the shock front, it relaxes to ordinary detonation conditions over hundreds of nanoseconds, since the material it encounters is no longer shock compressed and is not moving at high velocity along the shocked direction.

Superdetonation can be used to transform low performance explosives into explosives that perform better than conventional high performance explosives with detonation velocity greater than 10 km/s. Superdetonation, however, is transient, which typically is why superdetonation has not been exploited in explosives.

As disclosed herein, superdetonation can be used in explosive applications to reduce the amount of energetic material needed for a particular application. Superdetonation of the disclosed energetic materials can be used to drive applications in flyer production, shaped charge generation, and product gas jet formation. This use of superdetonation can be achieved by introducing a weak initial shock that is timed in such a manner that the superdetonation wave reaches the surface to be accelerated when the superdetonation is at its peak velocity.

Solely by way of example, while the detonation velocity of nitromethane is 6.3 km/s, the superdetonation velocity has been observed between 10.3-13 km/s. Though this superdetonation wave exists for less than a microsecond, methods to utilize and time superdetonation waves have been determined so that this increased velocity can be utilized in explosive devices.

The present disclosure includes materials, devices, and methods that utilize superdetonation to enhance explosive performance, for instance in a manner that is inexpensive and practical in a variety of applications, such as shock acceleration of metals, gases, and plasmas; shaped charge and jet cutting; penetration for military and/or industrial applications; improvised explosive device (IED) defeat; ordinance disposal; heat munitions; demolition; and combinations thereof. Solely by way of example, shaped charges can be used in combination with superdetonation because the liner (e.g., thin metal liner) utilized in a shaped charge can be usefully accelerated within the limited duration of the transient superdetonation wave. By using superdetonation, the amount of energetic material required for such applications can be reduced as compared to the amounts used in conventional normal detonation applications.

III. Material and Devices

Disclosed herein are embodiments of energetic materials capable of exhibiting superdetonation and devices utilizing such materials. By utilizing superdetonation, the disclosed energetic materials and devices use less energetic material and thereby provide a safer and cheaper means for making explosive devices. In some embodiments, the energetic materials are liquids. In some embodiments, the energetic materials are solids. The energetic materials typically are homogeneous. Energetic materials can be selected from nitro-containing hydrocarbons (e.g., nitroalkyls, such as nitroethane, nitromethane, nitrobutane, or the like; nitroalkenes; or nitroalkynes), nitrated organics (e.g., ethylene glycol dinitrate (EGDN), NG, ETN, PETN, or the like), nitro-containing aryls or nitro-containing heteroaryls (e.g., TNT, DNT, NB, HNS, NTO, TATB, or the like), hydrazines, or combinations thereof. Exemplary homogeneous energetic materials include, but are not limited to liquid explosives (such as nitromethane, nitroglycerin, and the like), or high density pressings of solid explosives (such as ETN, PETN, or TNT and the like). In particular disclosed embodiments, nitromethane can be used as the energetic material.

In some embodiments, the energetic material can be combined with a sensitizer component to facilitate tuning the energetic material from being a material capable of superdetonation to a material capable of normal detonation. The sensitizer component can be an amine component capable of reacting with the energetic material so as to sensitize it and reduce or eliminate the energetic material's ability to superdetonate. In some embodiments, the amine component can be an alkyl amine selected from diethylenetriamine (DETA), ethylenediamine (EDA), and the like. The sensitizer component can be added in an amount ranging from 0.01% to 10%, such as 0.1% to 5%, or 0.25% to 1%. In particular disclosed embodiments, the sensitizer component and energetic material can be used at a ratio of 0.01:99.99 to 10:90, such as 0.1:99.9 to 5:95, or 0.25:99.75 to 1:99.

Solely for purposes of illustration, nitromethane and its use in the devices and methods disclosed herein, is discussed in detail below; however, the present disclosure is not so limited and is readily applicable to other energetic materials, such as those described above. While nitromethane has been studied in respect to its superdetonation phenomena and has a well characterized equation of state, the properties of the double shocked material behind the superdetonation wave are less well characterized. Exemplary properties of nitromethane that can influence its performance in shaped charges are summarized in Table 1, along with data for the high performance plastic bonded explosive (PBX) 9501, which contains 95% HMX and 5% binder. Other energetic materials disclosed herein also are capable of exhibiting properties similar to nitromethane, though such materials may exhibit different values from those provided in Table 1. PBX 9501 can be used as a comparative embodiment to exhibit the superiority of the disclosed materials. In some embodiments, the pressures and particle velocities achieved in superdetonation are impedance matched with the reflected Hugoniot of copper as an unloading isentrope appropriate for basic considerations of assessing potential in generating flyers and shaped charges (see, for example, FIG. 3).

Notably, in some embodiments, the superdetonation in energetic materials, such as nitromethane, can drive a final velocity that can range from 30-50% higher than high performance energetic materials, such as PBX 9501. Similarly, the reaction products isentropically expand to a higher velocity in superdetonation as compared to regular detonation. Accordingly, the materials and devices disclosed herein can be used in a variety of applications in addition to shaped charges, such as high speed product gas jet formation. Calculations for one-dimensional planar geometries are provided for illustration, while applications can span a range of geometries—focusing on convergent shocks for high pressure shape charge drive. Calculations for both the von-Neumann spike condition (highest pressure spike right at the shock front illustrated in FIG. 2) as well as Chapman-Jouget conditions ("CJ"), which are lower pressures behind the spike at the sonic point near the end of the reaction zone, are shown to illustrate the range of conditions that flyers of different thicknesses can experience.

Figure 3:
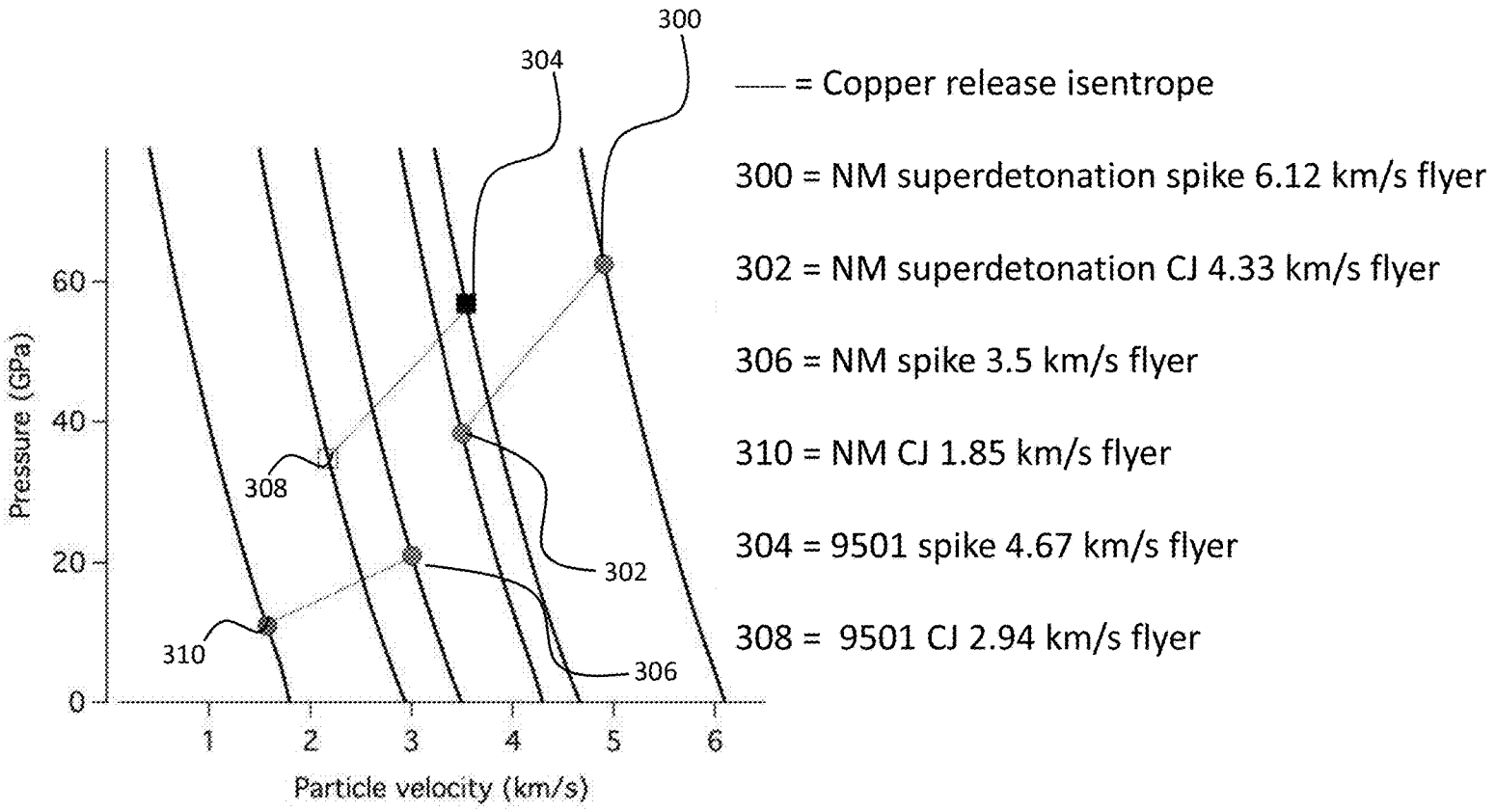
FIG. 3 is a graph of impedance matching from states achieved by nitromethane superdetonation and normal detonation, and PBX 9501 detonation illustrating that nitromethane superdetonation will produce 30-50% higher particle velocities than high performance PBX 9501.

As can be seen by the exemplary information provided by Table 1 and FIG. 3, embodiments of the disclosed energetic materials provide a greater ability to accelerate metal in the superdetonation regime than in the normal detonation regime. The information also illustrates the superiority of superdetonating such energetic materials over conventional high performance energetic materials, such as PBX 9501.

TABLE 1

| Material/condition | Pressure (GPa) | Particle Velocity (km/s) | Copper flyer velocity (km/s) |
|---|---|---|---|
| NM/superdetonation spike | 62.5 | 4.9 | 6.12 |
| NM/superdetonation CJ | 38.4 | 3.5 | 4.33 |
| NM/spike | 21 | 3.0 | 3.50 |
| NM/CJ | 11 | 1.6 | 1.85 |
| PBX 9501/spike | 56.9 | 3.54 | 4.67 |
| PBX 9501/CJ | 34.8 | 2.17 | 2.94 |

NM = nitromethane; spike = von-Neumann condition; NM data from Menikoff, R. and Shaw, M. S. "Modeling Detonation Waves in Nitromethane", *Combustion and Flame*, 158, 12, 2549-2558, 2011 and references therein; PBX 9501 data from Menikoff, R. "Detonation Waves in Pbx 9501", *Combustion Theory and Modelling*, 10, 6, 1003-1021, 2006 and references therein; copper velocity from impedance match to reflected Hugoniot (Rice, M. H., McQueen, R. G., and Walsh, J. M. "Compression of Solids by Strong Shock Waves", *Solid State Physics-Advances in Research and Applications*, 6, 1-63, 1958).

In some embodiments, the energetic materials capable of superdetonation can be used in a variety of devices. In some embodiments, the devices disclosed herein can be shaped charges. Basic properties and features of shaped charges are discussed in Walters, W. P. and Zukas, J. A., *Fundamentals of Shaped Charges*, USA. John Wiley and Sons. 1989, the relevant portion of which is incorporated herein by reference. In some embodiments, the shaped charge devices described herein can comprise a housing suitable for containing the materials that undergo superdetonation. The housing can be made of any suitable material, such as inert plastic, a Teflon-coated material, or the like. In some embodiments, the housing comprises a cost-efficient, readily-available material that is chemically compatible with the energetic material. For example, such housing materials should not chemically degrade when exposed to the energetic material and they should not deleteriously affect the energetic material. The housing also can have any suitable shape capable of containing certain components used to facilitate superdetonation. In some embodiments, the housing is conical, linear, cylindrical, or other suitable shapes. The housing comprises proximal end and distal end and corresponding proximal and distal portions. In some embodiments, the housing comprises a first chamber located within the distal portion of the housing. The housing also can comprise a detonator located near the proximal end of the housing. In some embodiments, the housing can further comprise a second chamber positioned between the detonator and the first chamber, which is configured to contain an attenuator. The first chamber has a length that is sufficient to allow a superdetonation wave produced by the energetic material to contact a liner prior to relaxation of the superdetonation wave to normal detonation pressure.

The housing also can comprise a liner or container that is coupled to the housing or configured to fit within the housing. The liner can be positioned at the distal end of the housing. In some embodiments, the liner or container can be coupled to the entire housing, or a portion of the housing. The liner or container can be made of any suitable material useful in explosives and superdetonation. The liner can have any suitable shape typically used in shaped charge application, such as hemispheres, linear, conical, tulip-shaped, ellipsoidal, or trumpet-shaped. In particular disclosed embodiments, the liner is a metal selected from copper, although other metals or ceramics can also be used. The liner also can have a thickness ranging from 0.001 to 20 mm, such as 0.01 to 10 mm, or 1 to 5 mm. In exemplary embodiments, the liner can be a flat copper plate, a conical copper liner, a linear (v-channel) copper liner, etc.

The housing can further comprise a detonator, a charge, a booster, an attenuator, and combinations thereof. The detonator can be selected from devices capable of initiating detonation in the booster charge, such as pyrotechnic or electric blasting caps, exploding bridgewires, or slapper detonators. The booster can comprise an energetic material as described herein and in some embodiments can further comprise a sensitizer so as to be cap sensitive. Suitable sensitizers are disclosed herein. In some embodiments, the sensitizer also can be added to the first chamber containing the energetic material capable of superdetonation so as to provide the ability to convert the superdetonation to normal detonation. Such sensitizers can be added to the device just prior to use through an opening present in the first chamber housing. The attenuator component can comprise any suitable inert material capable of adjusting the time and spatially dependent pressure wave input from the booster to an appropriate pressure, spatial structure, and duration to allow superdetonation to occur.

Figure 4:
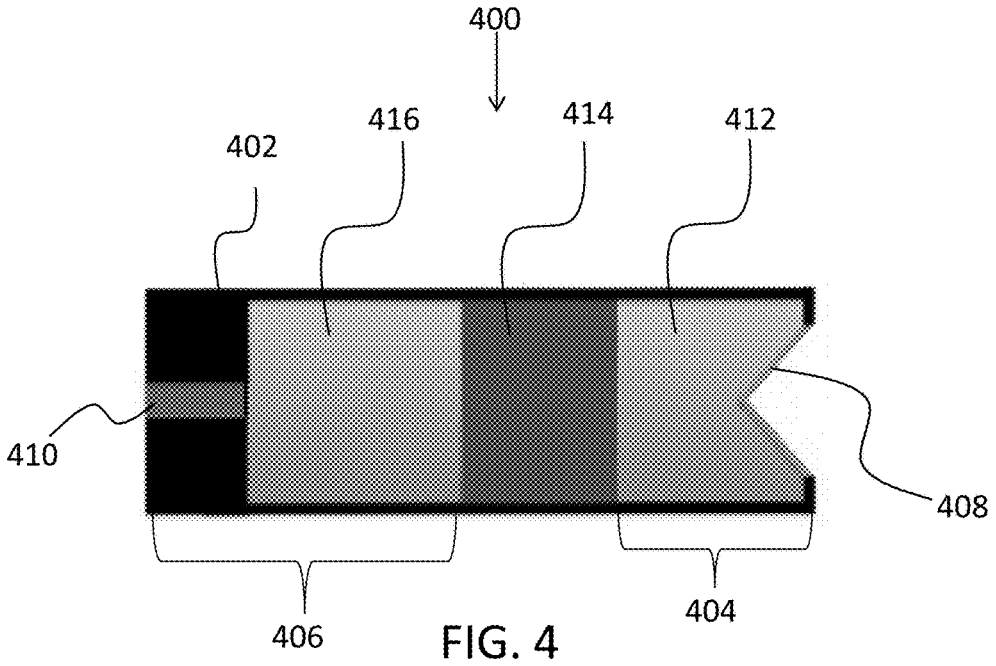
FIG. 4 illustrates a device for superdetonation and acceleration of a conical liner.

An exemplary schematic illustration of an exemplary device configuration and components contained therein is provided by FIG. 4. As illustrated in FIG. 4, device 400 can comprise housing 402, which comprises a distal portion 404 and proximal portion 406. Device 400 also comprises a metal liner 408 positioned at a distal end of the housing, a detonator 410, a first chamber 412 configured to contain an energetic material capable of superdetonation, a second chamber 414 configured to contain an attenuator, and a third chamber 416 configured to contain a booster. According to the embodiment illustrated in FIG. 4, detonator 410 can be positioned in proximal portion 402 and adjacent to third chamber 416. Second chamber 414 can be positioned between third chamber 416 and first chamber 414. First chamber 412 is positioned in distal portion 404 and has a length that is sufficient to allow a superdetonation wave produced by the energetic material to contact liner 408 prior to relaxation of the superdetonation wave to normal detonation pressure, which is the pressure that the energetic material would exhibit in the absence of superdetonation. In yet additional embodiments, first chamber 412 can further comprise a sensitizer that can change the device from a device capable superdetonation to a device capable of normal detonation.

Figure 5:
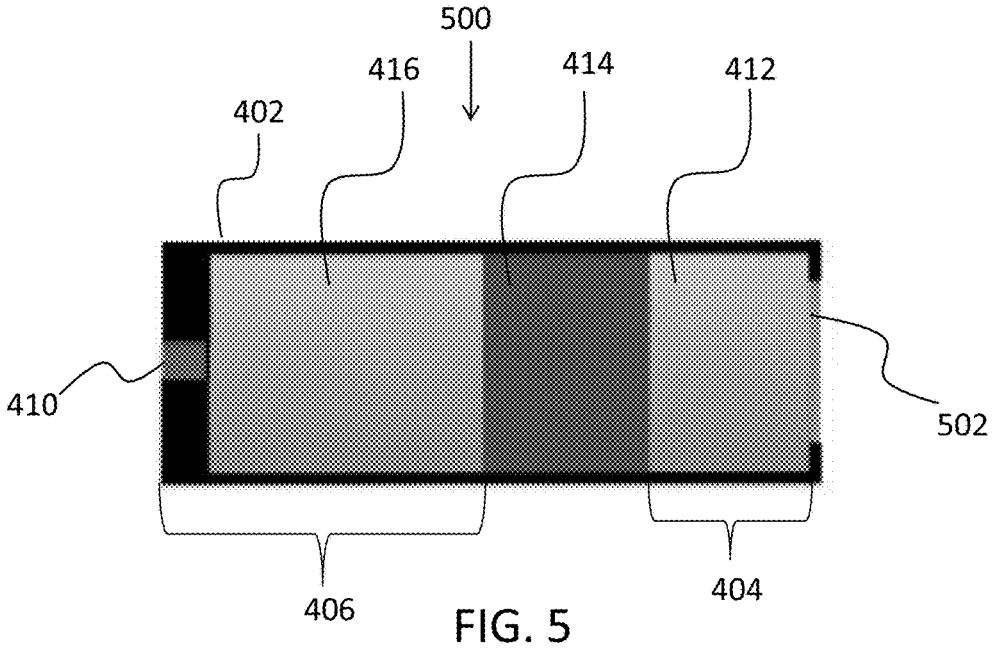
FIG. 5 illustrates a device for superdetonation and acceleration of a flat liner.

Another exemplary device is illustrated in FIG. 5. This embodiment comprises a linear liner portion 502 that is positioned at the distal end of device 500 and proximal to the energetic material capable of superdetonation 412.

IV. Methods of Making and Using Materials and Devices

The materials and devices disclosed herein constitute a unique pairing between energetic materials capable of superdetonation and metal liners that are sufficiently thin so as to be accelerated within the limited duration of the superdetonation wave prior to relaxation to normal detonation pressure.

The energetic materials disclosed herein can be used to obtain superdetonation waves that are capable of accelerating metal liners (e.g., flat copper plates, conical liners, linear v-channel liners, etc.) to velocities higher than can be achieved by detonating nitromethane under normal conditions (detonation velocity, D=6.3 km/s) and higher than detonating conventional high performance plastic explosives, such as C-4 (D=8.2 km/s). The devices disclosed herein comprise components and configurations that provide an appropriate spatial uniformity to allow for optimized timing of the input drive through the device components (e.g., through the booster, attenuator, and combinations thereof).

Figure 6:
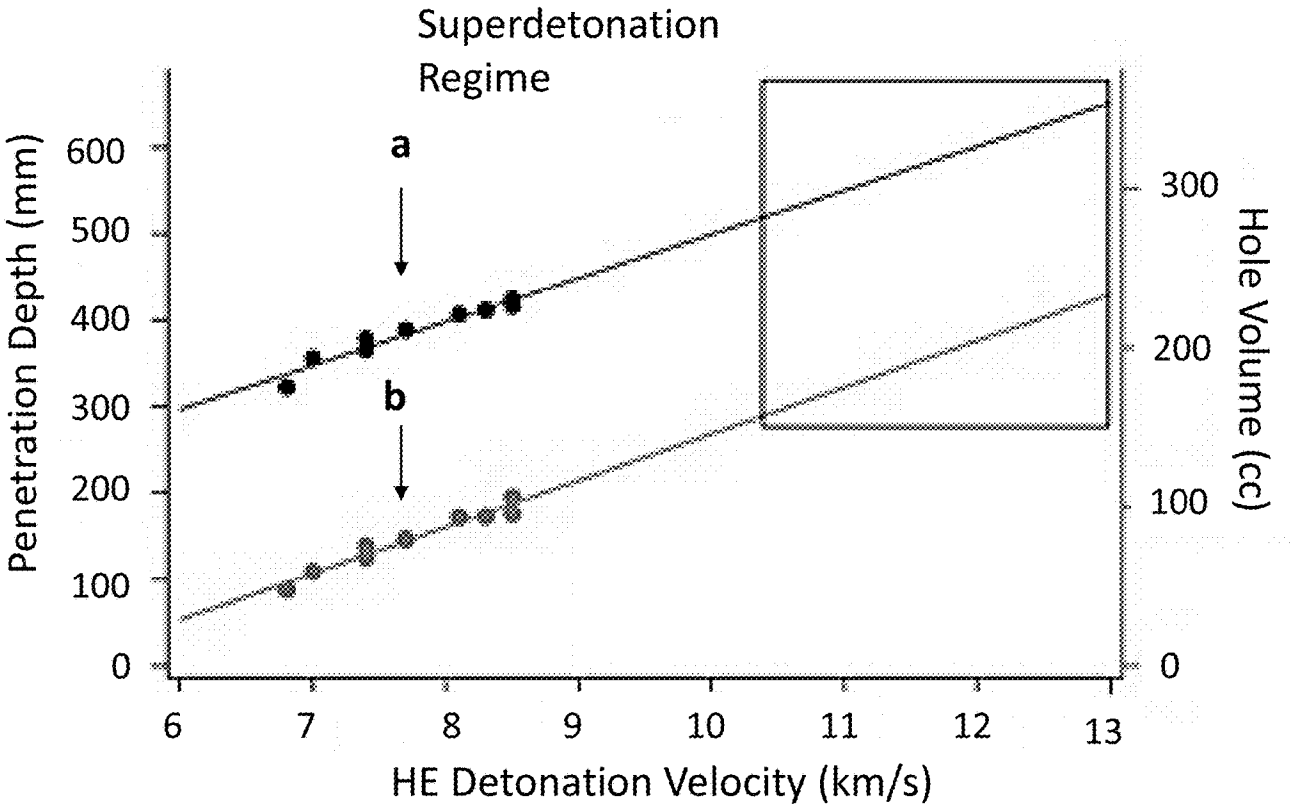
FIG. 6 is a graph of penetration depth (mm) and hole volume (cc) as a function of detonation velocity (km/s), which illustrates potential penetration depths and hole volumes that can be obtained using the superdetonation devices/methods disclosed herein as compared to normal detonation regimes.

Superdetonation involves careful control of the input shock conditions and run time, which is not trivial to apply to geometries typical of explosive shaped charge operations. In some embodiments, the damage and penetration caused by liners accelerated by superdetonating nitromethane can be determined and compared to detonating nitromethane in a conventional manner (e.g., normal detonation), and detonating high performance plastic explosives, such as C-4. In some embodiments, the devices and energetic materials disclosed herein can provide the ability to drive liners with simple device geometries (e.g., small size, single initiation point, etc.). The detonation velocity of an explosive is one factor in the performance of shaped charges. For a given shaped charge, increasing the explosive detonation velocity that drives the liner has been observed to increase both the penetration depth and the volume of the hole excavated by the shaped charge, as shown in FIG. 6, which includes data points (circles labeled "a" and "b") from J. Simon, "The effect of explosive detonation characteristics on shaped charge performance," AD-785, 680 (1974) at normal detonation velocities. Without being limited to a particular theory, it is currently believed that superdetonation at 13 km/s would outperform the best explosive data shown in FIG. 6 with approximately 50% increase in penetration depth (e.g., a 50% to 100% increase, or a 50% to 75% increase) and more than 100% increase in hole volume (e.g., a 100% to 200% increase, or a 100% to 150% increase), as can be seen by the region of the graph in FIG. 6 designated as the "superdetonation regime."

Wave shaping also can be used to achieve the highest shock velocity at different distances from the detonator (e.g., such as by using a shaped attenuator). For example, linear cutting liners can be used with a line wave generator, but may also be used with a sweeping wave from a point initiation for simplicity and smaller size.

By determining and controlling system timing, transient superdetonation can be used to accelerate high velocity metal liners for use in shaped charges. Superdetonation in the energetic materials disclosed herein applied to shaped charges can increase shaped charge penetration using smaller and less expensive explosive systems than current technology allows, make handling and transportation safer and easier, and allowing switching of system performance and sensitivity through injection of liquid chemicals. Precision shaped charges are widely used in demolition, breeching, unexploded ordnance disposal, hard target defeat, and well perforation. In some methods, a device as disclosed herein can be used to impact or penetrate a target. Such methods can comprise positioning the device at a distance ranging up to 100 charge diameters from the target and detonating the device. In some embodiments, the distance away from the target at which the device (such as a shaped charge) is positioned is measured in terms of the diameter of the shaped charge—so, solely by way of example, 100 charge diameters of distance would equate to a distance of 100 times the diameter of the liner used in the shaped charge. In some embodiments, the diameter of the device is measured as the largest diameter of the liner.

In some embodiments, methods are described for projecting a liner. Such methods can comprise superdetonating the energetic material contained within the device so as to project the liner at a velocity that can reach up to 140% higher, such as from 30% higher to 140% higher, or 50% higher to 140% higher, or 30% higher to 50% higher than a flyer velocity produced by regular detonation. Flyer velocity, as used in this context, refers to the velocity of the accelerated liner after explosive detonation.

Several embodiments disclosed herein, such as in those described in the Examples section, can be used to both verify and optimize the performance superiority of applied superdetonation in the energetic materials and devices disclosed herein. In some embodiments, the energetic materials can be evaluated using a one-dimensional right circular cylinder geometry. Shock input can be generated with high explosive drive attenuated with the attenuators described herein. Streak camera images of the breakout and velocimetry can be used to optimize the initial shock input conditions. In some embodiments, streak images and time of arrival pins can be used to determine the time at which the superdetonation wave produced by an energetic material disclosed herein overtakes the detonation wave to optimize drive conditions of the liner. Laser velocimetry can be used to measure the free surface velocity of the liner. In some embodiments, the performance of the energetic material capable of superdetonation can be evaluated by superdetonating the energetic material, detonating the energetic material with 5% DETA in the same geometry (which leads to normal detonation), as well as a high performance explosive (e.g., C-4), thereby providing the ability to measure superdetonation of the energetic materials as compared to regular detonation of the materials and/or high performance explosives.

In some embodiments, reactive hydrodynamic simulations can be used to optimize shaped charge geometries driven by superdetonation. The effect of shaped charges can be measured with witness plates (e.g., steel plates to assess penetration and damage) and high speed video. Conical and linear shaped charges can be tested for penetration and cutting applications.

In some embodiments, multi-dimensional configurations, such as shaped charges, can be designed to maintain the performance advantages achieved with superdetonation of the materials disclosed herein. As pressure is time dependent, the shock front should hit the surface at the right time, as shown in FIG. 2. This timing can be difficult to achieve in a geometry where the surface of a liner (e.g., a copper cone) is to be accelerated by the superdetonation. In some embodiments, a radially varying input shock pressure can be used, depending on the cone size and angle, to address this difficulty. Reflection and rarefaction waves can be accounted for. Small variations in shock strength are magnified by the temperature sensitivity shown in FIG. 1, and can cause changes in induction time. Thus, reactive burn hydrodynamic modeling can be used to address these issues. In some embodiments, bubbles or surface defects that can cause inhomogeneous initiation are controlled or eliminated by using the disclosed materials and devices.

From a reactive burn modeling perspective, the superdetonation phenomena is outside the normal range of calibrations for material properties, which can cause difficulties in making adequate predictions and optimizations of geometries. However, the materials and devices disclosed herein are tunable so that they can be modified to exhibit optimal geometries and designs, thereby addressing these potential issues.

V. Examples

Methods for testing devices utilizing energetic materials capable of superdetonation are described. In some examples, the methods relate to determining the ability of the disclosed devices to impact and penetrate one or more targets using superdetonation. In some other examples, the methods relate to determining the level of improved impact or penetration achieved by the disclosed devices using superdetonating energetic materials as compared to that obtained using devices and normal detonation conditions. In some examples, superdetonation of energetic materials in the disclosed devices is compared to normal detonation impact/penetration exhibited by high performance plastic explosives.

General Information:

In some examples, calculations for booster, attenuator, and superdetonation initiation are performed to set up initial parameters for determining the impact/penetration capabilities of the disclosed devices and for determining suitable parameters for initiating superdetonation. Pins and streak images are used to locate position/timing of the peak of the superdetonation wave exhibited by the energetic material so as to determine how the device can be modified to maximize the impact/penetration of the liner that is accelerated from the device by superdetonation. Timing reproducibility (shot to shot) and spatial front uniformity (breakout time variation) also are measured.

In some examples, methods of using the disclosed materials and devices can be evaluated at a firing facility equipped with diagnostic ports for electrical and optical access. Combinations of pins, streak cameras, framing cameras, laser velocimetry, high speed video, witness plates, and other experimental diagnostics can be used in the examples disclosed herein. In some examples, outdoor firing sites can also be utilized. In some examples, prep rooms can be used for shot assembly and magazines for explosive storage and machining, CAD, 3-D printing, and other fabrication capabilities.

The following examples are provided to illustrate certain particular features and/or embodiments. These examples should not be construed to limit the invention to the particular features or embodiments described.

Example 1

In one example, the velocity of a flat copper plate that is driven by superdetonation of the energetic material used in a device comprising the copper plate is evaluated so as to determine device parameters capable of providing maximum performance. The device is then modified, such as by adjusting the distance between the components of the device and the copper plate, so as to achieve a higher level of acceleration, impact, or penetration as measured by laser velocimetry or witness plate damage.

Example 2

In some examples, identical devices using 0.1% DETA added to the energetic material (e.g., nitromethane) can be used to determine the ability to chemically sensitize the energetic material. This example can be used to establish the ability of using the devices in field applications, such as when superdetonation of the device is no longer desired and instead normal detonation is required. Injection and mixing of 0.1% DETA to the nitromethane in the first chamber (e.g., 412 of FIG. 4) would occur prior to firing. The sensitization changes the timing required for the superdetonation wave to build and arrive at the liner, and instead a normal detonation proceeds through the first chamber (e.g., 412 of FIG. 4).

Example 3

In this example, embodiments of a design for a superdetonation system and device are described. To determine suitable device component configurations to be used with the energetic material capable of superdetonation, liner acceleration velocity at takeoff can be measured with planar flyers. Refinements to initial shock drive, procedures of assembly, or changes in design can then be implemented so as to improve or maximize device performance. In this example, the results of velocimetry, streak and pin timings are compared with detailed simulations of the reaction dynamics and hydrodynamic flow. Reactive burn modeling can be empirically adjusted to account for the conditions achieved by superdetonation and the Arrhenius kinetics occurring prior to superdetonation. For example, refined simulations can be used to predict optimized geometries for conical and linear shaped charges. In some embodiments it can be determined whether a simple right circular cylinder can be used as a housing for the components to be used to achieve superdetonation and whether this limits the angle of the cone or the size of charge. In some embodiments, it can be determined whether a toroidal geometry, or radial wave shaping prior to superdetonation can be used. Additionally, the optimal geometry to minimize the size and complexity of the device while maintaining good performance can be determined.

Example 4

In this example, an exemplary device comprising, for example, a housing, a detonator, a charge, and a liner is constructed to determine the amount of witness plate penetration using a conical liner. High speed video and witness plates are used to determine the progression of the superdetonation wave produced using an exemplary energetic material, such as nitromethane, and the impact of the shaped charged that is accelerated from the device after being impacted by the superdetonation wave. In an additional example, the superior penetration of witness plates produced by the constructed device can be compared to that achieved using a similarly constructed device but using either normal detonation of the energetic material and/or a high performance plastic explosive.

Example 5

In this example, an exemplary device comprising, for example, a housing, a detonator, a charge, and a liner is constructed to determine the amount of witness plate penetration using a linear v-channel liner. High speed video and witness plates are used to determine the progression of the superdetonation wave produced using an exemplary energetic material, such as nitromethane, and the impact of the shaped charged that is accelerated from the device after being impacted by the superdetonation wave. In an additional example, the superior penetration of witness plates produced by the constructed device can be compared to that achieved using a similarly constructed device but using either normal detonation of the energetic material and/or a high performance plastic explosive.

Example 6

This example describes a method for using a device disclosed herein to impact or penetrate a target. In this example, an exemplary device comprising, for example, a housing, a detonator, a charge, and a liner is constructed to determine the ability to cut or penetrate real world items of interest to applications. High speed video and post blast examination will be used to determine penetration of items such as reinforced concrete, metal ammunition casings, or armor materials.

In view of the many possible embodiments to which the principles of the present disclosure may be applied, it should be recognized that the illustrated embodiments are only preferred examples of the present disclosure and should not be taken as limiting the scope of the disclosure. Rather, the scope of the disclosure is defined by the following claims.

I claim:

1. A device, comprising:

a housing having a proximal portion and a distal portion;

a liner positioned at a distal end of the housing;

a detonator positioned in the proximal portion of the housing;

a first chamber, positioned in the distal portion of the housing, configured to contain a homogenous energetic material capable of superdetonation and which has a length sufficient to allow an input pressure wave to initiate a superdetonation wave produced by the homogenous energetic material, and to allow the superdetonation wave to contact the liner prior to relaxation of the superdetonation wave to normal detonation pressure; and a second chamber, positioned between the detonator and the first chamber, configured to contain an attenuator and a booster material.

2. The device of claim 1, in which the liner is sufficiently thin so as to be expelled from the device upon contact of the superdetonation wave produced by the homogenous energetic material.

3. The device of claim 1, further comprising the homogenous energetic material capable of superdetonation contained within the first chamber.

4. The device of claim 1, wherein the liner has a thickness ranging from 0.001 mm to 5 mm.

5. The device of claim 1, wherein the liner has an outer perimeter having dimensions smaller than an outer perimeter of the housing.

6. A device, comprising:

a housing having a proximal portion and a distal portion;

a liner positioned at a distal end of the housing;

a detonator positioned in the proximal portion of the housing;

a homogenous energetic material capable of superdetonation contained in a first chamber positioned in the distal portion of the housing, which first chamber has a length sufficient to allow an input pressure wave to initiate a superdetonation wave produced by the homogenous energetic material, and to allow the superdetonation wave to contact the liner prior to relaxation of the superdetonation wave to normal detonation pressure; and a second chamber comprising an attenuator and a booster material, wherein the second chamber is positioned between a detonator and the first chamber.

7. The device of claim 6, in which the attenuator is capable of shaping an input pressure to initiate superdetonation of the homogenous energetic material.

8. The device of claim 6, in which the homogenous energetic material comprises nitromethane, nitroglycerin, ethylene glycol dinitrate, pentaerythritol tetranitrate, erythritol tetranitrate, trinitrotoluene, or two or more thereof.

9. The device of claim 6, in which the booster material comprises an energetic material and an amine component.

10. The device of claim 9, wherein the amine component is an alkyl amine selected from diethylenetriamine (DETA), ethylenediamine (EDA), or a mixture thereof.

11. The device of claim 6, wherein the device is used for improvised explosive device (IED) defeat, ordinance disposal, high-explosive anti-tank (HEAT) munitions, demolition, or a combination thereof.

12. A method of making a device, comprising:

placing a homogenous energetic material capable of superdetonation into a first chamber of a housing, wherein the first chamber is located in a distal portion of the housing and has a length that is sufficient to allow an input pressure wave to initiate a superdetonation wave produced by the homogenous energetic material and to allow the superdetonation way to contact a liner prior to relaxation of the superdetonation wave to normal detonation pressure;

placing an attenuator and a booster material into a second chamber of the housing; and placing a detonator in a proximal portion of the housing.

13. The method of claim 12, further comprising placing a sensitizer component in the first chamber.

14. The method of claim 13, wherein the sensitizer component comprises an amine component.

15. The method of claim 14, wherein the amine component is an alkyl amine selected from diethylenetriamine (DETA), ethylenediamine (EDA), or a mixture thereof.

16. A method for projecting a liner, comprising superdetonating the homogenous energetic material contained within the device of claim 6, so as to project the liner at a flyer velocity from 30% higher to 140% higher than a flyer velocity produced by regular detonation of the same material.

17. The method of claim 16, wherein the liner is projected at a flyer velocity from 50% higher to 140% higher than a flyer velocity produced by regular detonation.

18. A method of impacting or penetrating a target, comprising:

positioning the device of claim 6 adjacent to the target at a distance up to 100 charge diameters from the target; and detonating the device.

19. The method of claim 18, wherein the target is a demolition target, an unexploded ordnance target, a hard target, or a well and wherein the method produces a 50% or higher increase in penetration depth and 100% or higher increase in hole volume as compared to the same energetic material in the same configuration under normal detonation conditions against the same target.

* * * * *